United States Patent [19]

Knestele

[11] Patent Number: 4,884,310

[45] Date of Patent: Dec. 5, 1989

[54] SHAMPOOING APPARATUS FOR CARPETS AND THE LIKE

[76] Inventor: Leopold Knestele, Biberacherstrasse 14, DE 7967 Bad Waldsee, Fed. Rep. of Germany

[21] Appl. No.: 208,887

[22] Filed: Jun. 17, 1988

[51] Int. Cl.[4] ..... A47L 11/34

[52] U.S. Cl. ..... 15/3; 15/98; 15/320; 401/21

[58] Field of Search ..... 15/50 R, 50 C, 98, 320, 15/3; 401/21

[56] References Cited

U.S. PATENT DOCUMENTS 2,976,112 3/1961 Yonkers et al. ..... 401/21
4,353,145 10/1982 Woodford ..... 15/320

FOREIGN PATENT DOCUMENTS 2039432 4/1976 Fed. Rep. of Germany .
2633152 1/1978 Fed. Rep. of Germany .
80281421 3/1981 Fed. Rep. of Germany .

*Primary Examiner*—Edward L. Roberts
*Attorney, Agent, or Firm*—Herbert Dubno

[57] ABSTRACT

A foam generator constituting or forming part of a carpet-cleaning apparatus has a foam body and a pressing element which alternately compresses and permits relaxation of the foam body to generate the foam with a cleaning liquid supplied to the foam body from the interior of the device. The foam is driven through apertures into the carpet therebelow.

11 Claims, 2 Drawing Sheets

1
2
3
4
4a
5
5a
6
6a
7
7a
8
9
10
11
12
13
14
14a
15
16
16a
M
T 3
5
14
15a
17
17a
18
19
M
T

SHAMPOOING APPARATUS FOR CARPETS AND THE LIKE

FIELD OF THE INVENTION

My present invention relates to an apparatus for cleaning carpets and, more particularly, to a shampooing apparatus adapted to be moved on the surface of a carpet for generating a carpet-cleaning foam by mixing air into a carpet-cleaning liquid containing a detergent and referred to generally as a shampoo.

BACKGROUND OF THE INVENTION

It is already known to clean carpets by applying a liquid to the carpet which has detergent qualities and is capable of being beaten up into a foam by brushes or rollers which engage the carpet surface and drive foam, as it is formed, into the nap of the carpet or between fibers thereof so that the foam can lift soil to the surface from which the foam, liquid and entrained soil can be vacuumed away.

In the prior art devices of this type, the foam is formed or applied by means of a brush, a belt or a roll.

In practice it has been found that these earlier systems can be inefficient with respect to the cleaning effect because the foaming may be insufficient and the manner in which the foam is generated from the cleaning liquid may not permit sufficient quantities of air to be beaten into the liquid for most effective foam generation and application.

OBJECTS OF THE INVENTION

It is the principal object of my present invention to provide a carpet-cleaning device or apparatus which can overcome the disadvantages described previously and generate a carpet-cleaning foam more efficiently than prior art devices.

Another object of my invention is to provide an improved foam generator for carpet-shampooing apparatus which will efficiently and reliably generate relatively large amounts of foam and, therefore promotes deep cleaning of carpets and the like.

SUMMARY OF THE INVENTION

These objects are attained, in accordance with the invention, in a device or apparatus for cleaning a carpet which includes or consists of a foam generator comprising:

- a housing displaceable over a carpet to be cleaned and provided with a housing moveable on the carpet and a housing wall turned toward and in contact with the carpet, the wall being provided with a multiplicity of apertures communicating between a chamber within the housing and the carpet;
- a sponge body in the compartment having a large-pore cellular structure compressible and expandable to foam a cleaning liquid applied to the carpet by mixing it with air upon alternating expansion and compression of the body;
- sponge-compression means in the housing for subjecting the body cyclically to alternating compression and expansion with a volume change per cycle of substantially 1:4; and
- a motor on the housing operatively connected to the sponge-compression means for driving same at a rate corresponding to a frequency of the compression and expansion cycles of about 100 per minute.

It will be apparent from the foregoing that the sponge body or bodies which are used in the foam generator constitute the major advance thereof over the art because the sponge bodies, which are made of plastic (synthetic resin) materials with large-pore cells have a high liquid and foam storage capacity so that large quantities of the cleaning liquid or foam are drawn from the carpet upon expansion of the sponge body and large quantities are driven into the carpet by the rhythmical and cyclical expansion (sucking) a compression sequence applied to the sponge body.

It will be appreciated that unlike systems in which the foam is beaten up on the surface of the carpet and thus only the small amount of liquid or foam in contact with the brush, belt or roller in contact with the carpet is effective at any point, the apparatus of the invention allows the sponge body in its expansion phase or on pressure relief to draw large amounts of the foam or liquid into the interior of the sponge body so that this liquid or foam can be mixed with air upon being expressed from the sponge body or bodies.

A high-pulse frequency and strong depth-penetration effect can be obtained with all types of carpet (deep nap as well as tightly-woven carpet).

I prefer to use a plastic sponge of the type marketed under the designation "GLASPORE" which, to the best of my knowledge, has never been used in the same or a similar application.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
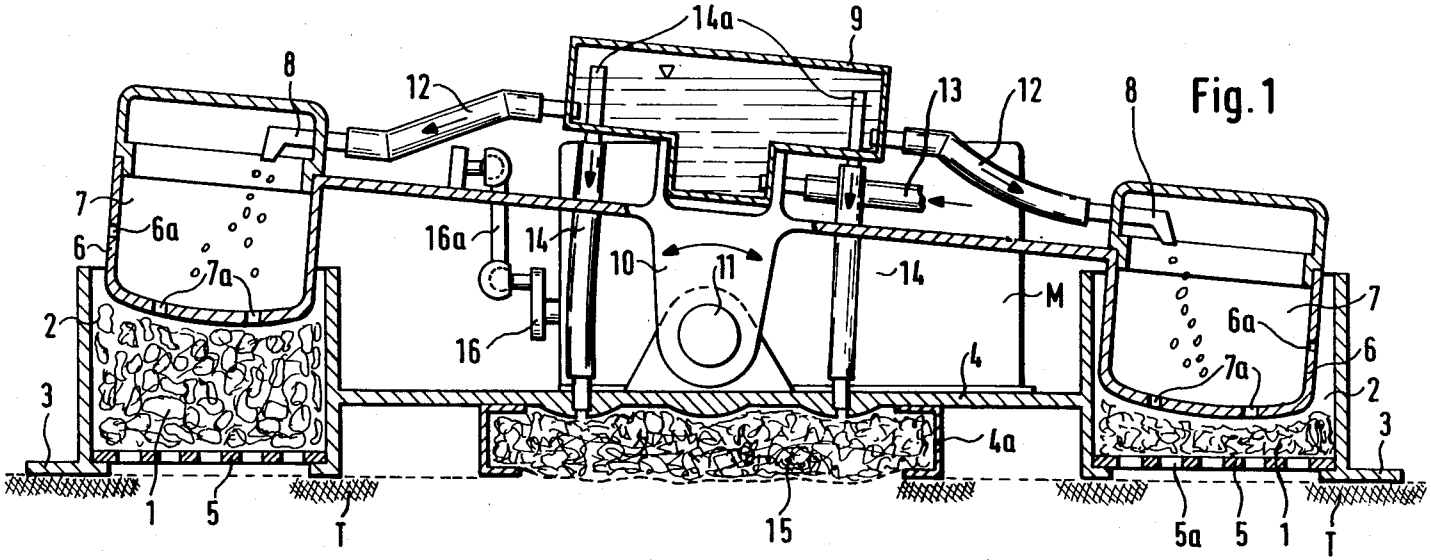
FIG. 1 is a cross sectional view through one embodiment of an apparatus in accordance with the invention.

In the embodiment shown in FIG. 1, a frame 3 forms a housing in which a bottom plate 5 is mounted removably, the bottom plate 5 forming a housing wall formed with apertures 5*a*. Sponge bodies 1 are received in housing chambers 2 bounded by the plate 5 and mounted on the frame 3 riding upon the carpet T. Between the chambers 2, the frame 3 has a wall portion 4 upon which a container 4*a* for the foaming agent 15 can be suspended.

The chambers 2 receive beam-shaped pressing members 6, provided with venting apertures 6*a*, which, when driven downwardly, compress the sponge bodies 1 in these chambers and thus drive the foam through the apertures 5*a* into the carpet. When the pressing member 6 are moved upwardly, the sponge bodies self-expand to imbibe large quantities of the liquid and the foam until the sponge body is again compressed. Thus the beam-shaped pressing members 6 serve for generating the pressing and expansion effects of the sponge bodies as described. Pipes 8 open into the cavities 7 of the pressing member 6 to deliver the cleaning liquid thereto and a tank 9 for the cleaning liquid.

The bottoms of the pressing members 6 have apertures 7a through which the cleaning liquid is supplied to the sponge bodies.

The pressing members 6 are mounted on the opposite ends or arms of a rocker lever 10 fulcrumed at a central bearing 11 on the frame and carrying the pipes 8, the tank 9 and the pressing members 6.

An electric motor M, mounted on the frame 3, 4 drives an eccentric 16 connected by a crank mechanism 16a to cause oscillation of the rocker lever. As the apparatus is moved over the carpet, therefore, and the foamable cleaning liquid is fed to the cavities 7a and then to the sponges 1, the alternate expansion and compression of these sponges forces cleaning foam deep into the carpet, the cleaning action being enhanced by the foaming action itself and the action of the cleaning sponge 15 forming a sponge plate. The soil-carrying foam can then be vacuumed away by means not shown, forming part of the apparatus described or an ancillary apparatus.

The rocker 10 generates a rhythmical or cyclical pulsation of the cleaning foam formed within the chambers 2. During each sucking movement of the pressing embers 6, the sponge bodies quickly expand drawing in unused foam and flush cleaning liquid which is foamed anew as the sponge bodies are compressed and the foam driven into the carpet.

When the compression ratio is such that in its expanded state the sponge has a volume about four times its volume in the compressed state, best results are obtained and it has been found that a pulse frequency of approximately 100 compressions per minute provides most effective cleaning.

The carpet shampoo or cleaning liquid for the sponge body 15 can flow via flexible pipes 12 to the pipes 8. The tank 9 can be refilled from an external source via the line 13. The flexible pipes 14 deliver the cleaning foam 15 and are so arranged with respect to the tank 9 that upon inclination of the latter, only the lower-lying mouthpiece 14a of the pipes 14 can receive the cleaning liquid, thereby metering this liquid to the sponge 15.

Figure 2:
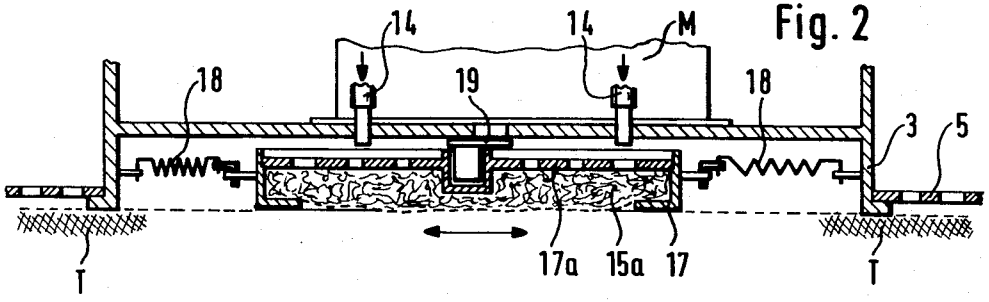
FIG. 2 is a cross section through the sponge plate together with its holding frame.

For large carpet areas, over which the appliance must be displaced for long stretches, I prefer to use the device of FIG. 2. Here the cleaning sponge is constituted as a sponge plate 15a of normal structure which can be replaceably mounted in a holding frame 17. This frame is suspended between tension springs 18 in the chassis 3 of the appliance and can be set in motion by an eccentric drive 19 via the motor M in a small circular-movement pattern.

This allows working of the foam into the carpet fibers in a particularly effective manner with limited pressing force. With the device it is not necessary to use a cleaning medium with high-foaming action. It suffices to employ a washing powder in the cleaning liquid, which after application and drying, is vacuumed up with the dirt released from the carpet.

Figure 3:
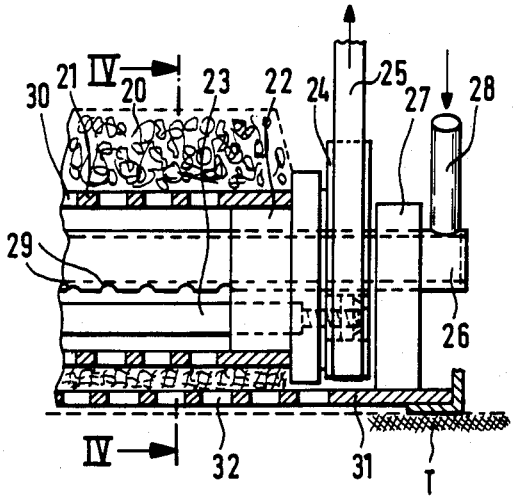
FIG. 3 is an axial section through an apparatus representing another embodiment thereof.
Figure 4:
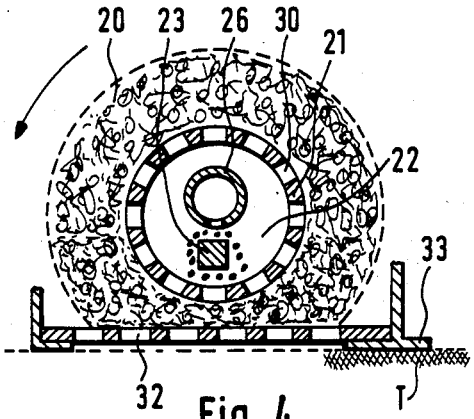
FIG. 4 is a section taken along the line IV—IV of FIG. 3.

FIGS. 3 and 4 show a similar effect obtained by the use of a cylindrical roll 20 which has a sponge outer body of a thickness of about 3 cm and is driven at a speed of about 100 revolutions per minute, the sponge lining of the roll 20 being the same as the sponge bodies 1 previously described.

The roll 20 has a perforated inner pipe 21 journaled via bearings 22 on an eccentrically positioned hollow shaft 26 to which the cleaning liquid is fed via a pipe 28. Perforations 29 in the hollow shaft communicate the cleaning liquid to the interior of the pipe 21 from whence, via the perforations 30 therein, cleaning liquid is delivered to the sponge covering.

A driving pin 23 extends into the members 22 rotatably mounting the roll on the eccentric shaft 26 and is connected to the pulley 24 driven by a flat belt 25 from an electric motor not illustrated in FIGS. 3 and 4.

A removable bottom plate 31 is affixed to the frame 33 of the apparatus and has apertures 32 delivering the foam to the underlying carpet T, the roll 20 being positioned so that it is compressed against the plate 31 but expands after each compressed portion passes out of contact with the plate (see FIG. 4).

As the plate 31 is slid over the carpet, the roll 20 is rotated and cleaning liquid is supplied as described so that cleaning foam is generated by the compression and expansion cycles and is forced into the carpet in the manner previously described.

The above-mentioned effects of the cleaning equipment as designed with the sponge body can also be obtained by mounting the sponge body to a rotating wobble plate in a manner as to be pressed to a permeable bottom plate and to perform rhythmical pressing and sucking impulse by its wobble movements.

I CLAIM:

1. A carpet shampooing apparatus comprising:

a housing displaceable over a carpet to be cleaned and provided with a housing wall facing and in contact with the carpet, said wall being provided with a multiplicity of apertures communicating between a chamber within said housing and the carpet;

a sponge body in said chamber having a large-pore cellular structure compressible and expandable to foam a cleaning liquid applied to said carpet by mixing it with air upon alternating expansion and compression of said body;

sponge-compression means in said housing for subjecting said body cyclically to alternating compression and expansion with a volume change per cycle of substantially 1:4; and a motor on said housing operatively connected to said sponge-compression means for driving same at a rate corresponding to a frequency of said compression and expansion cycles of about 100 per minute.

2. The carpet shampooing apparatus defined in claim 1 wherein said housing includes a frame having a central support, said sponge-compression means comprising a double-arm rocker lever fulcrumed on said support and provided on respective arms with respective hollow beam-shaped pressing members, said apparatus further comprising means for feeding said liquid to interiors of said pressing members, said housing being formed with means on said frame forming respective chambers each receiving a respective sponge body and a respective one of said pressing members, said pressing members having holes communicating between the interiors of said pressing members and the respective chamber, said motor being connected to said rocker lever by a crank drive for oscillating said rocker lever to cause said pressing members to alternately compress and expand said sponge bodies.

3. The carpet shampooing apparatus defined in claim 2 wherein said wall is a plate removably mounted on said frame.

4. The carpet shampooing apparatus defined in claim 1 wherein said housing is formed with a frame, and said sponge-compression means comprises a cylindrical drum rotatably mounted on said frame, said sponge body being a cylindrical body on said drum and being pressed thereby against said wall only along a portion of a rotary path of said drum and said body.

5. The carpet shampooing apparatus defined in claim 4 wherein said drum is perforated and connected with a source of said liquid.

6. The carpet shampooing apparatus defined in claim 4 wherein said drum is rotatable on a fixed hollow shaft which is eccentric to the axis of said drum and said motor is connected to said drum for rotating same.

7. The carpet shampooing apparatus defined in claim 1 wherein said sponge-compression means is a wobble plate driven by said motor and bearing on said sponge body.

8. The carpet shampooing apparatus defined in claim 1, further comprising a cleaning sponge replaceably mounted on said housing between two of said sponge bodies, supplied with said cleaning liquid and passed against said carpet.

9. The carpet shampooing apparatus defined in claim 8, further comprising a motor driven eccentric imparting to said cleaning sponge small circular movements with respect to said carpet.

10. A carpet shampooing apparatus comprising:

a housing displaceable over a carpet to be cleaned and having a downwardly open cavity;

a cleaning sponge in said cavity adapted to rub against the carpet;

means on said housing enabling movement of said cleaning sponge along said carpet relative to said housing; and means on said housing for feeding a cleaning liquid to said cleaning sponge, a holder being received in said cavity and provided with said cleaning sponge, said holder being provided with perforations along an upper side of said cleaning sponge, said means for feeding including tubes opening downwardly onto said holder whereby said cleaning liquid passes from said tubes into said cleaning sponge, said holder being displaced substantially parallel to the carpet by an eccentric driven by a motor on said housing.

11. The carpet shampooing apparatus defined in claim 10, further comprising a housing wall on said housing bounding a chamber in said housing and in contact with said carpet, said housing wall being provided with perforations, a sponge body in said chamber expandable to foam said cleaning liquid by mixing it with air upon alternating expansion and compression of said sponge body, a sponge compression means in said housing for subjecting said body cyclically to alternating compression and expansion, and a motor on said housing operatively connected to said sponge-compression means for driving same.

* * * * *